US009805682B2

(12) United States Patent
Wang et al.

(10) Patent No.: US 9,805,682 B2
(45) Date of Patent: Oct. 31, 2017

(54) SCANNING DRIVING CIRCUITS AND THE LIQUID CRYSTAL DEVICES WITH THE SAME

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventors: Cong Wang, Guangdong (CN); Peng Du, Guangdong (CN)

(73) Assignees: Shenzhen China Star Optoelectronics Technology Co., Ltd, Shenzhen, Guangdong (CN); WUHAN CHINA STAR OPTOELECTRONICS TECHNOLOGY CO., LTD, Wuhan, Hubei (CN)

( * ) Notice: Subject to any disclaimer, the term of this patent is extended or adjusted under 35 U.S.C. 154(b) by 122 days.

(21) Appl. No.: 14/888,698

(22) PCT Filed: Sep. 30, 2015

(86) PCT No.: PCT/CN2015/091195

§ 371 (c)(1),
(2) Date: Nov. 2, 2015

(87) PCT Pub. No.: WO2017/049662

PCT Pub. Date: Mar. 30, 2017

(65) Prior Publication Data

US 2017/0169782 A1 Jun. 15, 2017

(30) Foreign Application Priority Data

Sep. 25, 2015 (CN) ..... 2015 1 0624257

(51) Int. Cl.
*G09G 3/36* (2006.01)

(52) U.S. Cl.
CPC ... *G09G 3/3677* (2013.01); *G09G 2300/0809* (2013.01); *G09G 2310/0243* (2013.01); *G09G 2310/08* (2013.01)

(58) Field of Classification Search
CPC ..... G09G 2310/08
See application file for complete search history.

(56) References Cited

U.S. PATENT DOCUMENTS 8,040,999 B2 * 10/2011 Tobita ..... G11C 19/184 377/64
2008/0055225 A1 3/2008 Pak et al.
(Continued)

FOREIGN PATENT DOCUMENTS

CN 103985363 A 8/2014
CN 104732950 A 6/2015

*Primary Examiner* — Olga Merkoulova
(74) *Attorney, Agent, or Firm* — Andrew C. Cheng

(57) ABSTRACT

Provided are a scanning driving circuit and a liquid crystal display device. The scanning driving circuit comprises multiple cascaded scanning driving units (1). Each scanning driving unit (1) comprises an input module (100) for outputting a low-level signal and a plurality of driving circuits (200). Each driving circuit (200) corresponding drives one scanning line. Each driving circuit (200) comprises: a control module (210), for outputting a control signal according to the received low-level signal; an output module (220), and a pull-down module (230), for being connected or cut off according to the received control signal; scanning lines (G(N−1), G(N), G(N+1)), for outputting a high-level or low-level scanning driving signal to pixel units. When the output module (220) is cut off, the pull-down module (230) is connected, and the scanning lines (G(N−1), G(N), G(N+1)) output the low-level scan driving signals to the pixel units; and when the output module (220) is connected, the pull-down module (230) is cut off, and the scanning lines (G(N−1), G(N), G (N+1)) output high-level scanning driv-
(Continued)

ing signals to the pixel units. Accordingly, a circuit of the liquid crystal display device is simplified, and the space is saved, thereby facilitating the narrow-frame design of the liquid crystal display device.

12 Claims, 5 Drawing Sheets

(56) References Cited

U.S. PATENT DOCUMENTS

| | | | | |
|---|---|---|---|---|
| 2012/0075259 | A1* | 3/2012 | Chung | G09G 3/3266 345/204 |
| 2013/0106826 | A1* | 5/2013 | Zhou | G09G 3/36 345/212 |
| 2013/0321032 | A1* | 12/2013 | Chung | H03K 3/00 327/108 |
| 2016/0055818 | A1* | 2/2016 | Kim | H04N 13/0497 345/210 |
| 2016/0071474 | A1 | 3/2016 | Guo et al. | |
| 2017/0039968 | A1 | 2/2017 | Chen et al. | |

* cited by examiner

SCANNING DRIVING CIRCUITS AND THE LIQUID CRYSTAL DEVICES WITH THE SAME

BACKGROUND OF THE INVENTION

1. Field of the Invention

The present disclosure relates to liquid crystal display technology, and more particularly to a scanning driving circuit and the liquid crystal device (LCD) with the same.

2. Discussion of the Related Art

Currently, the LCDs adopt scanning driving circuit, that is, manufacturing the scanning driving circuit on the array substrate via the thin film transistor liquid crystal device (TFT-LCD) manufacturing process to realize the scanning method row by row. With respect to the LCD, each of the scanning driving circuits drives one scanning line. Generally, a plurality of scanning lines are configured in the LCD, and thus a great number of scanning driving circuits have to be configured. This may result in complicated circuit design. In addition, the scanning driving circuits may occupy a great deal of space, which may deteriorate the narrow border design of the LCDs.

SUMMARY

The object of the invention is to provide a scanning driving circuit and the LCD with the same. With such configuration, the circuit of the LCD is simplified and the space is reduced so as to accomplish the narrow border design.

In one aspect, a scanning driving circuit includes: a plurality of cascaded scanning driving units, each of the scanning driving units including: an input module outputting low level signals in accordance with received first clock signals, downstream signals at upper level, and downstream signals at current level; and a plurality of driving circuits, each of the driving circuits driving a corresponding scanning line, each of the driving circuits including: a control module connecting with the input module for receiving the low level signals outputted by the input module, and outputting control signals in accordance with the low level signals, second clock signals, and reset signals; an output module connecting with the control module for receiving the control signals outputted from the control module, and the output module is turned on or off in accordance with the control signals; a pull down module connects with the control module and the output module, the pull down module receives the control signals from the control module and is turned on or off in accordance with the control signals; at least one scanning line connected with the output module and the pull down module for outputting scanning driving signals at high level or at low level to pixel cells; and when the output module is turned off, the pull down module is turned on, and the scanning line outputs the scanning driving signals at low level to the pixel cells, when the output module is turned on, the pull down module is turned off, and the scanning line outputs the scanning driving signals at high level to the pixel cell.

Wherein the input module includes ten controllable switches including a first, a second, a third, a fourth, a fifth, a sixth, a seventh, an eighth, a ninth, and a tenth controllable switches, a control end of the first controllable switch connects with the first clock signals, an input end of the first controllable switch connects with a high level end, an output end of the first controllable switch connects with an output end of the second controllable switch, a control end of the second controllable switch connects with the first clock signals and the control end of the first controllable switch, an input end of the second controllable switch connects a low level end, a control end of the third controllable switch connects with the downstream signals at current level, an input end of the third controllable switch connects with the low level end, and an output end of the third controllable switch connects with an input end of the fourth controllable switch, a control end of the fourth controllable switch connects with the output end of the first controllable switch, an output end of the fourth controllable switch connects with an output end of the fifth controllable switch, and a control end of the fifth controllable switch connects with the downstream signals at upper level, an input end of the fifth controllable switch connects with an output end of the sixth controllable switch, a control end of the sixth controllable switch connects with the output end of the first controllable switch, an input end of the sixth controllable switch connects with the high level end, an input end of the seventh controllable switch connects with the input end of the sixth controllable switch and the high level end, a control end of the seventh controllable switch connects with the first clock signals, and an output end of the seventh controllable switch connects with an input end of the eighth controllable switch, a control end of the eighth controllable switch connects with the downstream signals at current level, an output end of the eighth controllable switch connects with an output end of the ninth controllable switch, a control end of the ninth controllable switch connects with the first clock signals, an input end of the ninth controllable switch connects with an output end of the tenth controllable switch, a control end of the tenth controllable switch connects with the downstream signals at upper level, an input end of the tenth controllable switch connects with the low level end, the output ends of the fourth controllable switch and the ninth controllable switch are connected to operate as the output end of the input module, and the output end of the input module connects with each of the driving circuits.

Wherein each of the driving circuits includes the eleventh, the twelfth, and the thirteen controllable switches, a control end of the eleventh controllable switch connects with the second clock signals, an input end of the eleventh controllable switch connects with the output end of the input module, and an output end of the eleventh controllable switch connects with output ends of the twelfth controllable switch and the thirteenth controllable switch, input ends of the twelfth controllable switch and the thirteenth controllable switch connect with the high level end, a control end of the twelfth controllable switch connects with third clock signals, a control end of the thirteenth controllable switch connects with the reset signals, and the output ends of the twelfth controllable switch and the thirteenth controllable switch are connected to operate as the output end of the control module, and the output end of the control module connects with the output module and the pull down module.

Wherein each of the driving circuits includes a fourteenth, a fifteenth, a sixteenth, and a seventeenth controllable switches, a control end of the fourteenth controllable switch connects with control ends of the fifteenth controllable switch and the control module, an input end of the fourteenth controllable switch connects with the high level end, an output end of the fourteenth controllable switch connects with an output end of the fifteenth controllable switch, an input end of the fifteenth controllable switch connects with the low level end, a control end of the sixteenth controllable switch connects with the output end of the fourteenth controllable switch, an input end of the sixteenth controllable switch connects with an input end of the seventeenth controllable switch and fourth clock signals, an output end of the sixteenth controllable switch connects with the scanning line corresponding to the driving circuit and an output end of the seventeenth controllable switch, a control end of the seventeenth controllable switch connects with the output end of the control module and the pull down module.

Wherein the pull down module of each of the driving circuits includes an eighteenth controllable switch, a control end of the eighteenth controllable switch connects with the output end of the control module, an input end of the eighteenth controllable switch connects with the low level end, and an output end of the eighteenth controllable switch connects with the scanning line and the output end of the seventeenth controllable switch.

Wherein the first controllable switch, the fifth controllable switch, the sixth controllable switch, the seventh controllable switch, the eighth controllable switch, the fourteenth controllable switch, and the seventeenth controllable switch are PMOS thin film transistor (TFT), and the second controllable switch, the third controllable switch, the fourth controllable switch, the ninth controllable switch, the tenth controllable switch, the eleventh controllable switch, the twelfth controllable switch, the thirteenth controllable switch, the fifteenth controllable switch, the sixteenth controllable switch, and the eighteenth controllable switch are NMOS TFT.

Wherein high-level time periods of the downstream signals at upper level, downstream signals at current level, and the fourth clock signals are triple up, and a frequency of the first clock signals switching between the high level and the low level has been decreased to ⅓ to ensure turn-on periods of the scanning driving signals remain the same.

Wherein each of the driving circuits controls the corresponding scanning line to output different scanning driving signals in accordance with different second clock signals, the first clock signals and the downstream signals at upper level are low level signals, and the downstream signals at current level and the fourth clock signals are high level signals.

Wherein the scanning circuit includes three driving circuits.

In another aspect, a LCD includes any one of the above scanning driving circuit.

In view of the above, the input module receives the first clock signals, the downstream signals at upper level, and the downstream signals at current level, and outputs the low level signals respectively to the control modules of the driving circuits. As such, the control modules of each of the driving circuits outputs the control signals in accordance with the received low level signals, the second clock signals, and the reset signals. The control signals controls the corresponding output modules and the pull down modules to turn on or turn off such that the corresponding scanning line of each of the driving circuits provides the scanning driving signals to the driving circuit. In this way, the circuit of the LCD may be simplified and the space may be reduced so as to realize the narrow border design.

DETAILED DESCRIPTION OF THE EMBODIMENTS

Embodiments of the invention will now be described more fully hereinafter with reference to the accompanying drawings, in which embodiments of the invention are shown.

Figure 1:
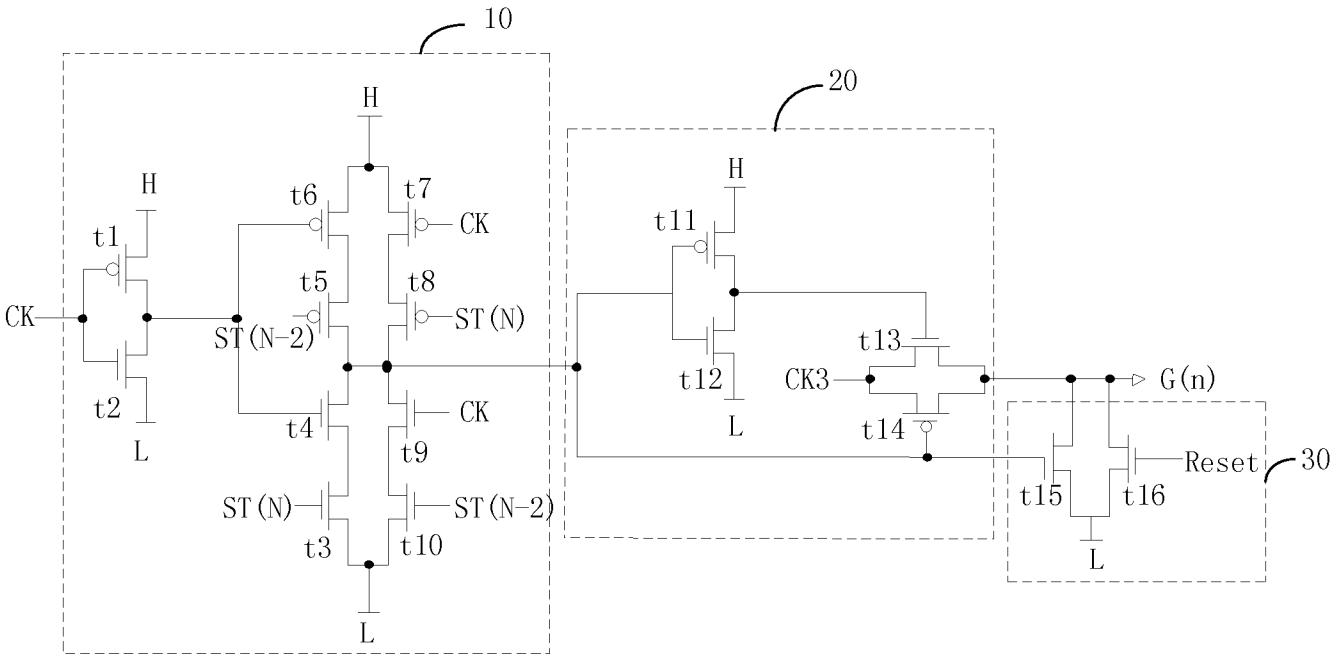
FIG 1 (Prior Art)
FIG. 1 is a schematic view of one conventional scanning driving circuit.
Figure 2:
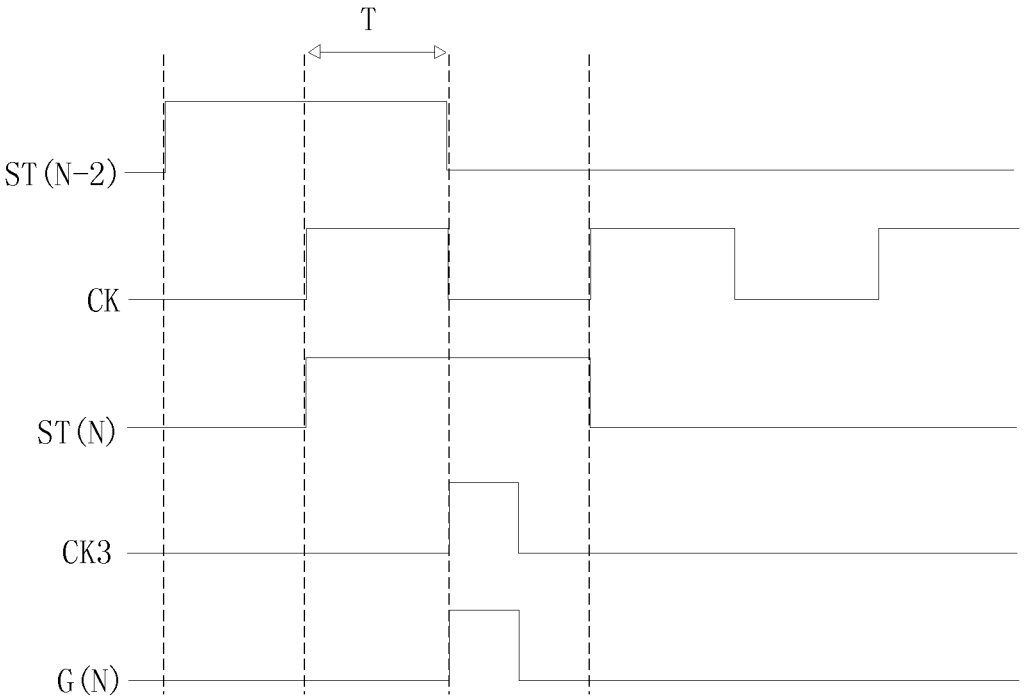
FIG 2 (Prior Art)
FIG. 2 is a waveform diagram of the conventional scanning driving circuit.

As shown in FIG. 1, the conventional LCD includes a plurality of scanning lines and a plurality of corresponding scanning driving circuits. With respect to the conventional LCD, each of the scanning driving circuits only drives one scanning line. Each of the scanning driving circuits includes an input module 10, an output module 20, and a pull-down module 30, which results in the complicated circuit design. FIG. 2 is a waveform diagram of the conventional scanning driving circuit. The downstream signals and the first clock signals (CK) from upper level ST (N−2) are at low level. When the downstream signals at the current level are at high level, the transistor (t1) converts the low level signals into high level signals so as to turn on the transistor (t3) and the transistor (t4). The input module 10 outputs the low level signals, and the transistor (t13) and the transistor (t14) of the output module 20 are turned on. When the second clock signals (CK3) are at high level, the scanning driving signals at high level are outputted to the corresponding scanning line connected with the scanning driving circuit. The principles of the scanning driving circuit at the next level are the same.

Figure 3:
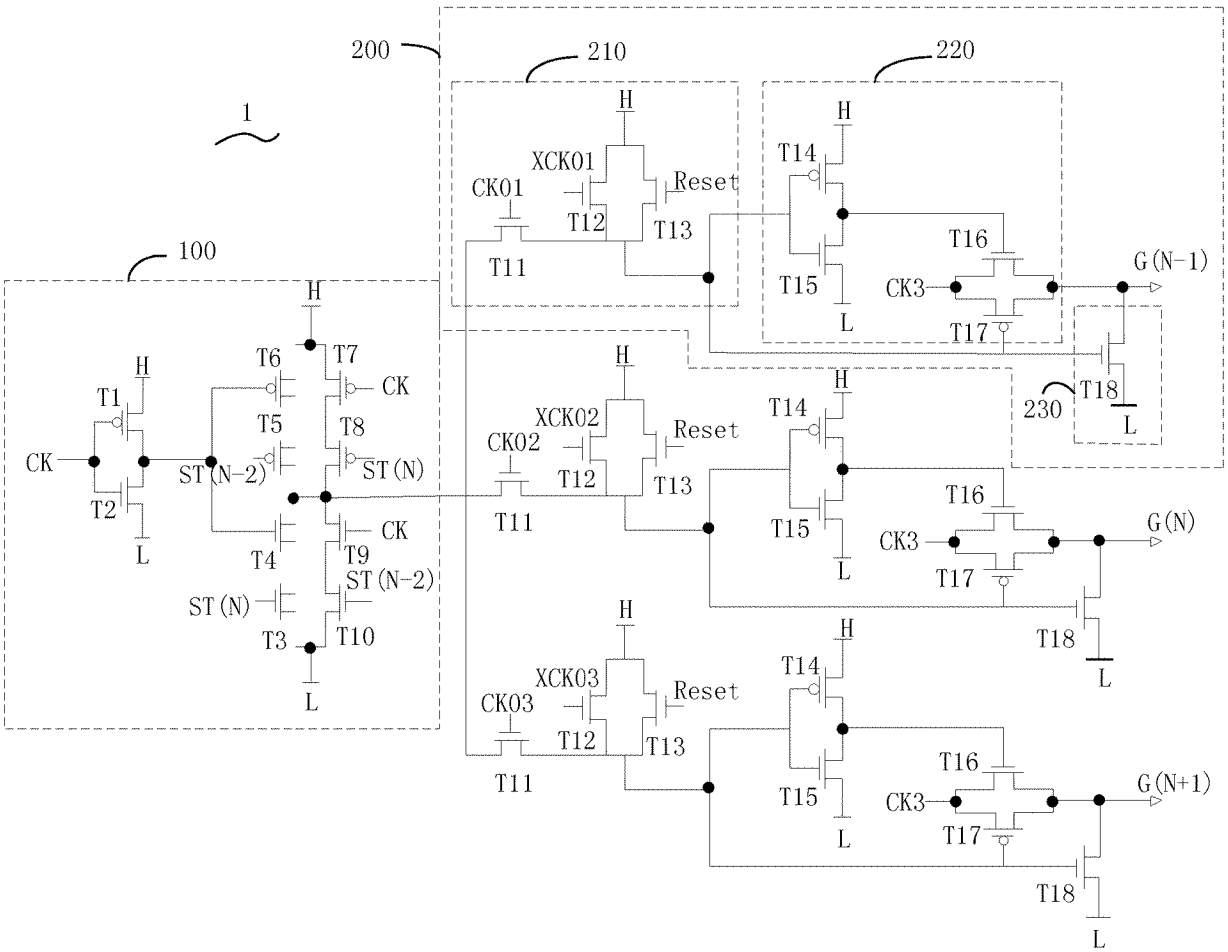
FIG. 3 is a schematic view of the scanning driving circuit in accordance with one embodiment.

FIG. 3 is a schematic view of the scanning driving circuit in accordance with one embodiment. As shown in FIG. 3, the scanning driving circuit includes a plurality of cascaded scanning driving units 1. Each of the scanning driving units 1 includes an input module 100 and a plurality of driving circuits 200. Each of the driving circuit 200 drives one corresponding scanning line. In the embodiment, only one scanning driving units 1 is taken as one example to illustrate the present disclosure. The driving circuit 200 includes three driving circuits for respectively driving the scanning line G(N−1), G(N), and G(N+1).

The input module 100 outputs the low level signals in accordance with the received first clock signals, the downstream signals at upper level, and the downstream signals at the current level. Each of the driving circuits 200 includes a control module 210 connecting with the input module 100 for receiving the low level signals outputted by the input module 100. The driving circuit 200 also outputs the control signals in accordance with the low level signals, the second clock signals, and the reset signals. The output module 220 connecting with the control module 210 for receiving the control signals outputted from the control module 210. The driving circuit 200 is configured to turn on or to turn off in accordance with the received control signals. The pull down module 230 connects with the control module 210 and the output module 220. The pull down module 230 receives the control signals from the control module 210 and is turned on or off in accordance with the control signals. The scanning line connect with the output module 220 and the pull down module 230 for outputting the scanning driving signals at high level or at low level to pixel cells. When the output module 220 is turned off, the pull down module 230 is turned on. As such, the scanning driving signals at low level from the scanning line is outputted to the pixel cell. When the output module 220 is turned on, the pull down module 230 is turned off. As such, the scanning line outputs the scanning driving signals at high level to the pixel cell.

The input module 100 includes ten controllable switches T1-T10. A control end of the first controllable switch T1 connects with the first clock signals. The input end of the first controllable switch T1 connects with a high level end (H), the output end of the first controllable switch T1 connects with the output end of the second controllable switch T2, the control end of the second controllable switch T2 connects with the first clock signals and the control end of the first controllable switch T1, the input end of the second controllable switch T2 connects a low level end (L). The control end of the third controllable switch T3 connects with the downstream signals of the current level, the input end of the third controllable switch T3 connects with the low level end (L), and the output end of the third controllable switch T3 connects with the input end of the fourth controllable switch T4. The control end of the fourth controllable switch T4 connects with the output end of the first controllable switch T1, the output end of the fourth controllable switch T4 connects with the output end of the fifth controllable switch T5, and the control end of the fifth controllable switch T5 connects with the downstream signals of the upper level. The input end of the fifth controllable switch T5 connects with the output end of the sixth controllable switch T6, the control end of the sixth controllable switch T6 connects with the output end of the first controllable switch T1, the input end of the sixth controllable switch T6 connects with the high level end (H). The input end of the seventh controllable switch T7 connects with the input end of the sixth controllable switch T6 and the high level end (H), the control end of the seventh controllable switch T7 connects with the first clock signals, and the output end of the seventh controllable switch T7 connects with the input end of the eighth controllable switch T8. The control end of the eighth controllable switch T8 connects with the downstream signals at the current level, the output end of the eighth controllable switch T8 connects with the output end of the ninth controllable switch T9. The control end of the ninth controllable switch T9 connects with the first clock signals, the input end of the ninth controllable switch T9 connects with the output end of the tenth controllable switch T10. The control end of the tenth controllable switch T10 connects with the downstream signals at the upper level, the input end of the tenth controllable switch T10 connects with the low level end (L). The output ends of the fourth controllable switch T4 and the ninth controllable switch T9 are connected to operate as the output end of the input module 100. The output end of the input module 100 connects with each of the driving circuits 200.

The control module 210 of each of the driving circuits 200 includes the controllable switches T11-T13. The control end of the eleventh controllable switch T11 connects with the second clock signals, the input end of the eleventh controllable switch T11 connects with the output end of the input module 100, and the output end of the eleventh controllable switch T11 connects with the output ends of the twelfth controllable switch T12 and the thirteenth controllable switch T13. The input ends of the twelfth controllable switch T12 and the thirteenth controllable switch T13 connects with the high level end (H). The control end of the twelfth controllable switch T12 connects with the third clock signals, the control end of the thirteenth controllable switch T13 connects with the reset signals, and the output ends of the twelfth controllable switch T12 and the thirteenth controllable switch T13 are connected to operate as the output end of the control module 210. The output end of the control module 210 connects with the output module 220 and the pull down module 230.

The output module 220 of each of the driving circuits 200 includes the controllable switches T14-T17. The control end of the fourteenth controllable switch T14 connects with the control ends of the fifteenth controllable switch T15 and the control module 210. The input end of the fourteenth controllable switch T14 connects with the high level end (H), the output end of the fourteenth controllable switch T14 connects with the output end of the fifteenth controllable switch T15, the input end of the fifteenth controllable switch T15 connects with the low level end (L). The control end of the sixteenth controllable switch T16 connects with the output end of the fourteenth controllable switch T14, the input end of the sixteenth controllable switch T16 connects with the input end of the seventeenth controllable switch T17 and the fourth clock signals. The output end of the sixteenth controllable switch T16 connects with the scanning line corresponding to the driving circuit 200, such as G(N−1), and the output end of the seventeenth controllable switch T17. The control end of the seventeenth controllable switch T17 connects with the output end of the control module 210 and the pull down module 230.

The pull down module 230 of each of the driving circuits 200 includes an eighteenth controllable switch T18. The control end of the eighteenth controllable switch T18 connects with the output end of the control module 210, the input end of the eighteenth controllable switch T18 connects with the low level end (L), the output end of the eighteenth controllable switch T18 connects with the scanning line and the output end of the seventeenth controllable switch T17.

The first controllable switch T1, the fifth controllable switch T5, the sixth controllable switch T6, the seventh controllable switch T7, the eighth controllable switch T8, the fourteenth controllable switch T14, and the seventeenth controllable switch T17 are PMOS thin film transistor (TFT). The second controllable switch T2, the third controllable switch T3, the fourth controllable switch T4, the ninth controllable switch T9, the tenth controllable switch T10, the eleventh controllable switch T11, the twelfth controllable switch T12, the thirteenth controllable switch T13, the fifteenth controllable switch T15, the sixteenth controllable switch T16, and the eighteenth controllable switch T18 are NMOS TFT.

In the embodiment, the first clock signals may be the first clock signals (CK), the downstream signals at upper level may be the downstream signals from the upper level ST(N−2), the downstream signals at current level may be the downstream signals at current level ST(N), the second clock signals are respectively the second clock signals CK01, CK02, and CK03, the third clock signals are respectively the third clock signals XCK01, XCK02, and XCK03, the reset signals are the reset signals Reset, the fourth clock signals are the fourth clock signals CK3, the scanning lines may be G(N−1), G(N), and G(N+1), wherein the second and the third clock signals corresponding to the scanning line G(N−1) are CK01 and XCK01, the second and the third clock signals corresponding to the scanning line G(N) are CK02 and XCK02, and the second and the third clock signals corresponding to the scanning line G(N+1) are CK03 and XCK03. Each of the driving circuits 200 controls the corresponding scanning line to output different scanning driving signals in accordance with different second clock signals. The first clock signals and the downstream signals at upper level are low level signals, and the downstream signals at current level and the fourth clock signals are high level signals.

The operations of the scanning driving circuit will be described hereinafter.

When the first clock signals (CK) and the downstream signals at upper level ST(N−2) are at low level and the downstream signals at current level ST(N) are at high level, the first controllable switch T1 is turned on and the output end of first controllable switch T1 outputs high level signals. The fourth controllable switch T4 is turned on and the sixth controllable switch T6 is turned off. The control end of the third controllable switch T3 is turned on for the reason that the downstream signals at current level ST(N−2) received by the control end of the third controllable switch T3 are at high level. Thus, the output end of the fourth controllable switch T4 is connected to the low level end (L) for the reason that the third controllable switch T3 and the fourth controllable switch T4 are turned on. As such, the low level signals are outputted to the control module 210 of each of the driving circuits 200. It can be understood that the driving circuit 200 connecting with the corresponding scanning line G(n−1) is taken as one example to illustrate the present disclosure, and the operations of other driving circuits 200 are the same.

When the second clock signals CK01 received by the control module 210 of the driving circuit 200 are at high level, and the reset signals (Reset) and the third clock signals XCK01 are at low level, the eleventh controllable switch T11 is turned on, and the twelfth controllable switch T12 and the thirteenth controllable switch T13 are turned off. At this moment, the output ends of the twelfth controllable switch T12 and the thirteenth controllable switch T13, that is, the output end of the control module 210 outputs the control signals at low level to the output module 220 and the pull down module 230. When the output module 220 receives the low level signals outputted from the control module 210, the fifteenth controllable switch T15 and the eighteenth controllable switch T18 are turned off, and the fourteenth controllable switch T14 is turned on. The high level signals outputted from the output end of the fourteenth controllable switch T14 turn on the sixteenth controllable switch T16, and the control end of the seventeenth controllable switch T17 receives the low level control signals from the control module 210 so as to be turned on. When the second clock signals (CK3) are at high level, the scanning line G(n−1) receives the scanning driving signals at high level outputted from the driving circuit 200 and then the scanning driving signals are transmitted to the pixel cells.

When the second clock signals CK01 received by the control module 210 of the driving circuit 200 are at low level, and the reset signals (Reset) and the third clock signals XCK01 are at high level, the eleventh controllable switch T11 is turned off and the twelfth controllable switch T12 and the thirteenth controllable switch T13 are turned on. At this moment, the output ends of the twelfth controllable switch T12 and the thirteenth controllable switch T13, i.e., the output end of the control module 210, output the high level control signals to the output module 220 and the pull down module 230. When the output module 220 receives the high level signals outputted from the control module 210, the fourteenth controllable switch T14 is turned off, and the fifteenth controllable switch T15 is turned on. The low level signals outputted from the output end of the fifteenth controllable switch T15 turns off the sixteenth controllable switch T16. The control end of the seventeenth controllable switch T17 is turned off after receiving the high level signals outputted from the control module 210. The control end of the eighteenth controllable switch T18 is turned on after receiving the high level signals outputted from the control module 210. In this way, the scanning line G(n−1) is connected to the low level end (L) such that the scanning line G(n−1) transmits the scanning driving signals at low level to the pixel cells.

Figure 4:
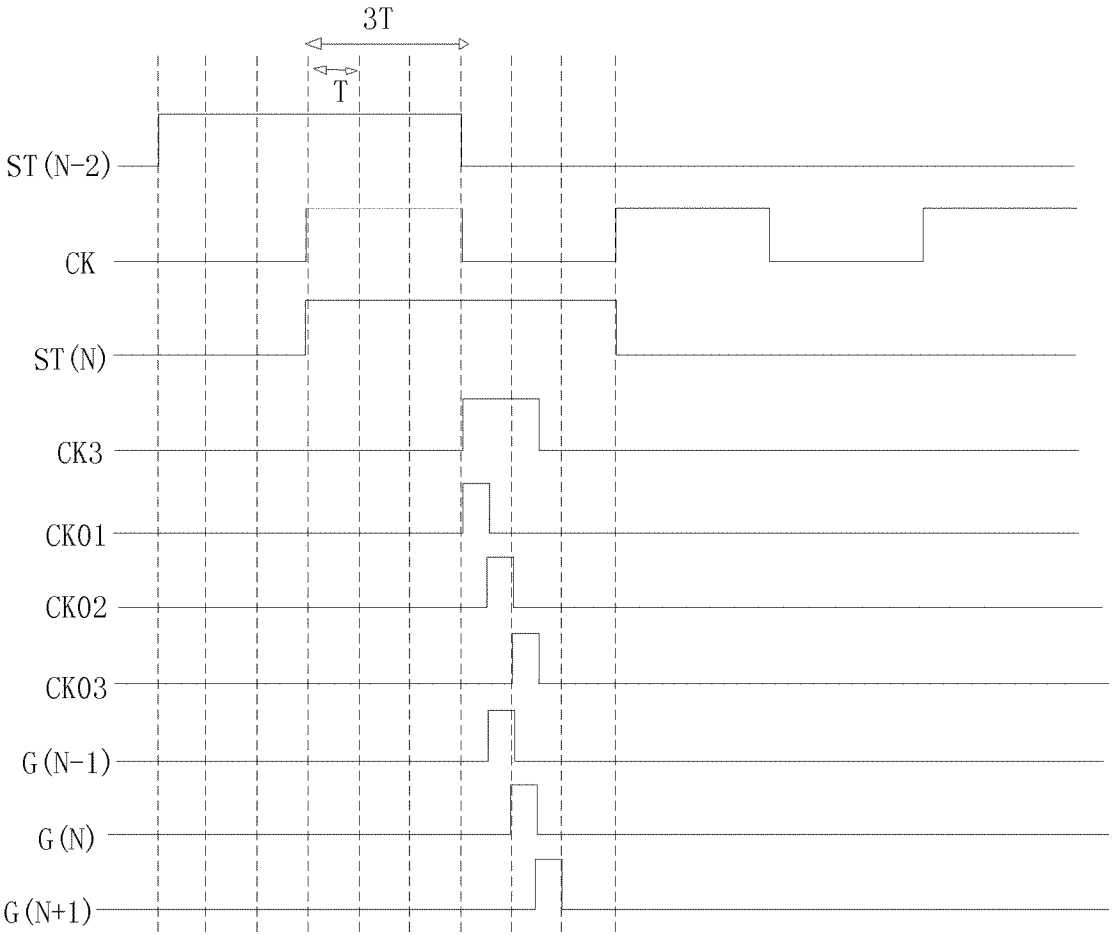
FIG. 4 is a waveform diagram of the scanning driving circuit in accordance with one embodiment.

FIG. 4 is a waveform diagram of the scanning driving circuit in accordance with one embodiment. To ensure the turn-on time period of the scanning driving signals remain the same, the high-level time period of the downstream signals at upper level, downstream signals at current level, and the fourth clock signals are triple up. Thus, the frequency of the first clock signals switching between the high level and the low level has been decreased to ⅓.

Figure 5:
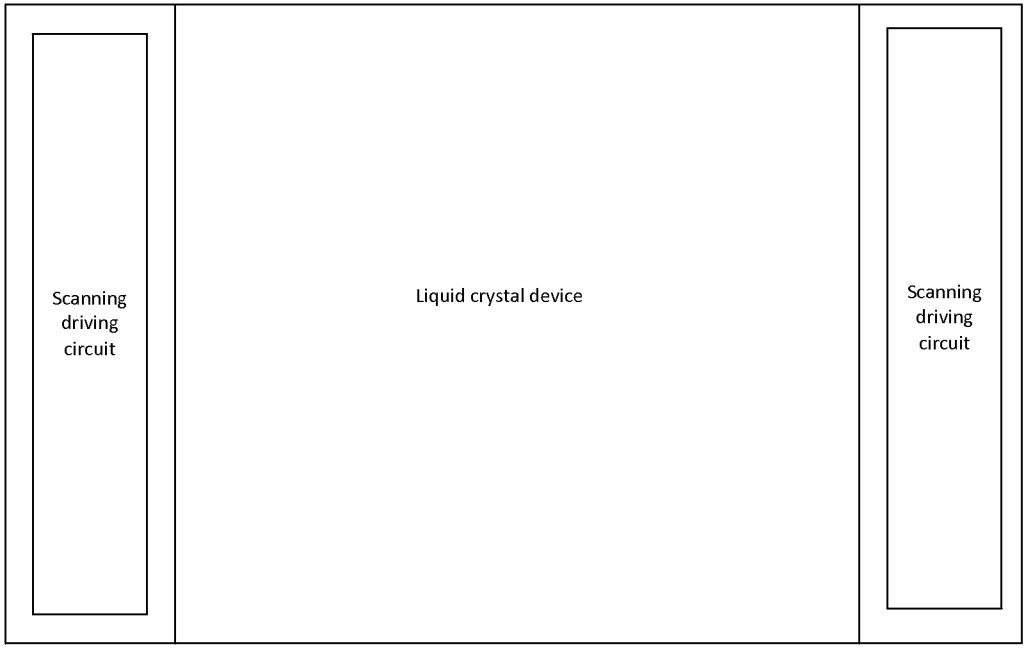
FIG. 5 is a schematic view of the LCD in accordance with one embodiment.

FIG. 5 is a schematic view of the LCD in accordance with one embodiment. The LCD includes the above scanning driving circuits being arranged at two ends of the LCD.

In view of the above, the input module 100 receives the first clock signals, the downstream signals at upper level, and the downstream signals at current level, and outputs the low level signals respectively to the control modules 210 of the driving circuits 200. As such, the control modules 210 of each of the driving circuits 200 outputs the control signals in accordance with the received low level signals, the second clock signals, and the reset signals. The control signals controls the corresponding output modules 220 and the pull down modules 230 to turn on or turn off such that the corresponding scanning line of each of the driving circuits 200 provides the scanning driving signals to the driving circuit 200. In this way, the circuit of the LCD may be simplified and the space may be reduced so as to realize the narrow border design.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A scanning driving circuit, comprising:

a plurality of cascaded scanning driving units, each of the scanning driving units comprising:

an input module outputting low level signals in accordance with received first clock signals, downstream signals at upper level, and downstream signals at current level; and a plurality of driving circuits, each of the driving circuits driving a corresponding scanning line, each of the driving circuits comprising:

a control module connecting with the input module for receiving the low level signals outputted by the input module, and outputting control signals in accordance with the low level signals, second clock signals, and reset signals;

an output module connecting with the control module for receiving the control signals outputted from the control module, and the output module is turned on or off in accordance with the control signals;

a pull down module connects with the control module and the output module, the pull down module receives the control signals from the control module and is turned on or off in accordance with the control signals;

at least one scanning line connected with the output module and the pull down module for outputting scanning driving signals at high level or at low level to pixel cells; and when the output module is turned off, the pull down module is turned on, and the scanning line outputs the scanning driving signals at low level to the pixel cells, when the output module is turned on, the pull down module is turned off, and the scanning line outputs the scanning driving signals at high level to the pixel cell wherein the input module comprises ten controllable switches comprising a first, a second, a third, a fourth, a fifth, a sixth, a seventh, an eighth, a ninth, and a tenth controllable switches, a control end of the first controllable switch connects with the first clock signals, an input end of the first controllable switch connects with a high level end, an output end of the first controllable switch connects with an output end of the second controllable switch, a control end of the second controllable switch connects with the first clock signals and the control end of the first controllable switch, an input end of the second controllable switch connects a low level end, a control end of the third controllable switch connects with the downstream signals at current level, an input end of the third controllable switch connects with the low level end, and an output end of the third controllable switch connects with an input end of the fourth controllable switch, a control end of the fourth controllable switch connects with the output end of the first controllable switch, an output end of the fourth controllable switch connects with an output end of the fifth controllable switch, and a control end of the fifth controllable switch connects with the downstream signals at upper level, an input end of the fifth controllable switch connects with an output end of the sixth controllable switch, a control end of the sixth controllable switch connects with the output end of the first controllable switch, an input end of the sixth controllable switch connects with the high level end, an input end of the seventh controllable switch connects with the input end of the sixth controllable switch and the high level end, a control end of the seventh controllable switch connects with the first clock signals, and an output end of the seventh controllable switch connects with an input end of the eighth controllable switch, a control end of the eighth controllable switch connects with the downstream signals at current level, an output end of the eighth controllable switch connects with an output end of the ninth controllable switch, a control end of the ninth controllable switch connects with the first clock signals, an input end of the ninth controllable switch connects with an output end of the tenth controllable switch, a control end of the tenth controllable switch connects with the downstream signals at upper level, an input end of the tenth controllable switch connects with the low level end, the output ends of the fourth controllable switch and the ninth controllable switch are connected to operate as the output end of the input module, and the output end of the input module connects with each of the driving circuits;

wherein each of the driving circuits comprises the eleventh, the twelfth, and the thirteen controllable switches, a control end of the eleventh controllable switch connects with the second clock signals, an input end of the eleventh controllable switch connects with the output end of the input module, and an output end of the eleventh controllable switch connects with output ends of the twelfth controllable switch and the thirteenth controllable switch, input ends of the twelfth controllable switch and the thirteenth controllable switch connect with the high level end, a control end of the twelfth controllable switch connects with third clock signals, a control end of the thirteenth controllable switch connects with the reset signals, and the output ends of the twelfth controllable switch and the thirteenth controllable switch are connected to operate as the output end of the control module, and the output end of the control module connects with the output module and the pull down module;

wherein each of the driving circuits comprises a fourteenth, a fifteenth, a sixteenth, and a seventeenth controllable switches, a control end of the fourteenth controllable switch connects with control ends of the fifteenth controllable switch and the control module, an input end of the fourteenth controllable switch connects with the high level end, an output end of the fourteenth controllable switch connects with an output end of the fifteenth controllable switch, an input end of the fifteenth controllable switch connects with the low level end, a control end of the sixteenth controllable switch connects with the output end of the fourteenth controllable switch, an input end of the sixteenth controllable switch connects with an input end of the seventeenth controllable switch and fourth clock signals, an output end of the sixteenth controllable switch connects with the scanning line corresponding to the driving circuit and an output end of the seventeenth controllable switch, a control end of the seventeenth controllable switch connects with the output end of the control module and the pull down module.

2. The scanning driving circuit as claimed in claim 1, wherein the pull down module of each of the driving circuits comprises an eighteenth controllable switch, a control end of the eighteenth controllable switch connects with the output end of the control module, an input end of the eighteenth controllable switch connects with the low level end, and an output end of the eighteenth controllable switch connects with the scanning line and the output end of the seventeenth controllable switch.

3. The scanning driving circuit as claimed in claim 2, wherein the first controllable switch, the fifth controllable switch, the sixth controllable switch, the seventh controllable switch, the eighth controllable switch, the fourteenth controllable switch, and the seventeenth controllable switch are PMOS thin film transistor (TFT), and the second controllable switch, the third controllable switch, the fourth controllable switch, the ninth controllable switch, the tenth controllable switch, the eleventh controllable switch, the twelfth controllable switch, the thirteenth controllable switch, the fifteenth controllable switch, the sixteenth controllable switch, and the eighteenth controllable switch are NMOS TFT.

4. The scanning driving circuit as claimed in claim 1, wherein high-level time periods of the downstream signals at upper level, downstream signals at current level, and the fourth clock signals are triple up, and a frequency of the first clock signals switching between the high level and the low level has been decreased to ⅓ to ensure turn-on periods of the scanning driving signals remain the same.

5. The scanning driving circuit as claimed in claim 1, wherein each of the driving circuits controls the corresponding scanning line to output different scanning driving signals in accordance with different second clock signals, the first clock signals and the downstream signals at upper level are low level signals, and the downstream signals at current level and the fourth clock signals are high level signals.

6. The scanning driving circuit as claimed in claim 1, wherein the scanning circuit includes three driving circuits.

7. A liquid crystal device (LCD), comprising:

at least one scanning driving circuit comprising a plurality of cascaded scanning driving units, each of the scanning driving units comprising:

an input module outputting low level signals in accordance with received first clock signals, downstream signals at upper level, and downstream signals at current level; and a plurality of driving circuits, each of the driving circuits driving a corresponding scanning line, each of the driving circuits comprising:

a control module connecting with the input module for receiving the low level signals outputted by the input module, and outputting control signals in accordance with the low level signals, second clock signals, and reset signals;

an output module connecting with the control module for receiving the control signals outputted from the control module, and the output module is turned on or off in accordance with the control signals;

a pull down module connects with the control module and the output module, the pull down module receives the control signals from the control module and is turned on or off in accordance with the control signals;

at least one scanning line connected with the output module and the pull down module for outputting scanning driving signals at high level or at low level to pixel cells; and when the output module is turned off, the pull down module is turned on, and the scanning line outputs the scanning driving signals at low level to the pixel cells, when the output module is turned on, the pull down module is turned off, and the scanning line outputs the scanning driving signals at high level to the pixel cell;

wherein the input module comprises ten controllable switches comprising a first, a second, a third, a fourth, a fifth, a sixth, a seventh, an eighth, a ninth, and a tenth controllable switches, a control end of the first controllable switch connects with the first clock signals, an input end of the first controllable switch connects with a high level end, an output end of the first controllable switch connects with an output end of the second controllable switch, a control end of the second controllable switch connects with the first clock signals and the control end of the first controllable switch, an input end of the second controllable switch connects a low level end, a control end of the third controllable switch connects with the downstream signals at current level, an input end of the third controllable switch connects with the low level end, and an output end of the third controllable switch connects with an input end of the fourth controllable switch, a control end of the fourth controllable switch connects with the output end of the first controllable switch, an output end of the fourth controllable switch connects with an output end of the fifth controllable switch, and a control end of the fifth controllable switch connects with the downstream signals at upper level, an input end of the fifth controllable switch connects with an output end of the sixth controllable switch, a control end of the sixth controllable switch connects with the output end of the first controllable switch, an input end of the sixth controllable switch connects with the high level end, an input end of the seventh controllable switch connects with the input end of the sixth controllable switch and the high level end, a control end of the seventh controllable switch connects with the first clock signals, and an output end of the seventh controllable switch connects with an input end of the eighth controllable switch, a control end of the eighth controllable switch connects with the downstream signals at current level, an output end of the eighth controllable switch connects with an output end of the ninth controllable switch, a control end of the ninth controllable switch connects with the first clock signals, an input end of the ninth controllable switch connects with an output end of the tenth controllable switch, a control end of the tenth controllable switch connects with the downstream signals at upper level, an input end of the tenth controllable switch connects with the low level end, the output ends of the fourth controllable switch and the ninth controllable switch are connected to operate as the output end of the input module, and the output end of the input module connects with each of the driving circuits;

wherein each of the driving circuits comprises the eleventh, the twelfth, and the thirteen controllable switches, a control end of the eleventh controllable switch connects with the second clock signals, an input end of the eleventh controllable switch connects with the output end of the input module, and an output end of the eleventh controllable switch connects with output ends of the twelfth controllable switch and the thirteenth controllable switch, input ends of the twelfth controllable switch and the thirteenth controllable switch connect with the high level end, a control end of the twelfth controllable switch connects with third clock signals, a control end of the thirteenth controllable switch connects with the reset signals, and the output ends of the twelfth controllable switch and the thirteenth controllable switch are connected to operate as the output end of the control module, and the output end of the control module connects with the output module and the pull down module;

wherein each of the driving circuits comprises a fourteenth, a fifteenth, a sixteenth, and a seventeenth controllable switches, a control end of the fourteenth controllable switch connects with control ends of the fifteenth controllable switch and the control module, an input end of the fourteenth controllable switch connects with the high level end, an output end of the fourteenth controllable switch connects with an output end of the fifteenth controllable switch, an input end of the fifteenth controllable switch connects with the low level end, a control end of the sixteenth controllable switch connects with the output end of the fourteenth controllable switch, an input end of the sixteenth controllable switch connects with an input end of the seventeenth controllable switch and fourth clock signals, an output end of the sixteenth controllable switch connects with the scanning line corresponding to the driving circuit and an output end of the seventeenth controllable switch, a control end of the seventeenth controllable switch connects with the output end of the control module and the pull down module.

8. The LCD as claimed in claim 7, wherein the pull down module of each of the driving circuits comprises an eighteenth controllable switch, a control end of the eighteenth controllable switch connects with the output end of the control module, an input end of the eighteenth controllable switch connects with the low level end, and an output end of the eighteenth controllable switch connects with the scanning line and the output end of the seventeenth controllable switch.

9. The LCD as claimed in claim 8, wherein the first controllable switch, the fifth controllable switch, the sixth controllable switch, the seventh controllable switch, the eighth controllable switch, the fourteenth controllable switch, and the seventeenth controllable switch are PMOS thin film transistor (TFT), and the second controllable switch, the third controllable switch, the fourth controllable switch, the ninth controllable switch, the tenth controllable switch, the eleventh controllable switch, the twelfth controllable switch, the thirteenth controllable switch, the fifteenth controllable switch, the sixteenth controllable switch, and the eighteenth controllable switch are NMOS TFT.

10. The LCD as claimed in claim 7, wherein high-level time periods of the downstream signals at upper level, downstream signals at current level, and the fourth clock signals are triple up, and a frequency of the first clock signals switching between the high level and the low level has been decreased to ⅓ to ensure turn-on periods of the scanning driving signals remain the same.

11. The LCD as claimed in claim 7, wherein each of the driving circuits controls the corresponding scanning line to output different scanning driving signals in accordance with different second clock signals, the first clock signals and the downstream signals at upper level are low level signals, and the downstream signals at current level and the forth clock signals are high level signals.

12. The LCD as claimed in claim 7, wherein the scanning circuit includes three driving circuits.

* * * * *